US008413822B2

(12) United States Patent
Bailey

(10) Patent No.: US 8,413,822 B2
(45) Date of Patent: Apr. 9, 2013

(54) COOKBOOK RACK

(76) Inventor: Audrey Bailey, Tallahassee, FL (US)

( * ) Notice: Subject to any disclaimer, the term of this patent is extended or adjusted under 35 U.S.C. 154(b) by 340 days.

(21) Appl. No.: 12/456,164

(22) Filed: Jun. 12, 2009

(65) Prior Publication Data

US 2010/0314341 A1 Dec. 16, 2010

(51) Int. Cl.
*A47B 65/00* (2006.01)
*A47G 29/00* (2006.01)
*A47F 5/00* (2006.01)

(52) U.S. Cl. ..... 211/43; 211/85.29; 211/175

(58) Field of Classification Search ..... 211/43, 211/42, 96–102, 197, 90.03, 106, 85.29, 211/181.1, 119, 175, 86.01, 87.01, 133.5, 211/133.6; 248/441.1, 447, 447.2, 447.7, 248/465.1, 454, 462; 312/313, 323, 246–248
See application file for complete search history.

(56) References Cited

U.S. PATENT DOCUMENTS 651,058 A * 6/1900 Rogers ..... 248/441.1
1,220,578 A * 3/1917 Wise ..... 108/139
1,373,027 A * 3/1921 Simon ..... 108/8
2,232,635 A * 2/1941 Rogers ..... 211/43
2,494,382 A * 1/1950 Faulkner et al. ..... 312/233
2,560,721 A * 7/1951 Gibson ..... 312/233
2,599,416 A * 6/1952 Saecker ..... 248/447
2,638,701 A * 5/1953 Dahlgren ..... 248/445
2,839,349 A * 6/1958 Culver ..... 312/323
3,228,648 A * 1/1966 Tils ..... 248/447
3,635,351 A * 1/1972 Homs ..... 211/42
3,791,677 A * 2/1974 Nawman ..... 281/46
3,809,352 A * 5/1974 Mathias ..... 248/444.1
3,846,005 A * 11/1974 Harper et al. ..... 312/248
3,918,672 A * 11/1975 Torn et al. ..... 248/447
3,967,807 A * 7/1976 Claxton ..... 248/447
4,184,725 A * 1/1980 Spangler ..... 312/233
4,269,381 A * 5/1981 Harms ..... 248/465.1
D264,159 S * 5/1982 Bennett et al. ..... D6/555
4,343,244 A * 8/1982 Moriarty et al. ..... 108/1
4,369,948 A * 1/1983 Krauss et al. ..... 248/444.1
4,460,145 A * 7/1984 Ando ..... 248/447
4,690,285 A * 9/1987 Stone ..... 211/70.6
5,069,350 A 12/1991 Wolff et al.
5,215,364 A * 6/1993 Moore ..... 312/323
5,242,142 A * 9/1993 Nakamura ..... 248/280.11
5,271,593 A * 12/1993 Kinner et al. ..... 248/442.2
5,415,372 A * 5/1995 Shepherd et al. ..... 248/447
5,439,195 A * 8/1995 Jessee ..... 248/447
5,646,819 A * 7/1997 Hill, III ..... 361/679.6
5,772,174 A * 6/1998 Hirsch et al. ..... 248/447.1
5,860,535 A * 1/1999 Brown ..... 211/42
5,931,102 A * 8/1999 Grahl ..... 108/42
6,155,439 A * 12/2000 Draughn ..... 211/85.13
6,435,634 B1 * 8/2002 Webb et al. ..... 312/313
6,619,609 B2 9/2003 Cress
7,124,988 B1 * 10/2006 Duffy et al. ..... 248/284.1
7,252,279 B2 * 8/2007 Conibear ..... 248/447

(Continued)

*Primary Examiner* — Jennifer E. Novosad
(74) *Attorney, Agent, or Firm* — J. Wiley Horton; Adrienne C. Love

(57) ABSTRACT

A rack for holding and displaying cookbooks. The rack is generally comprised of a shelf unit, a swivel arm, a slide and a tray. The swivel arm is pivotally attached to the base of shelf. The slide fits over the swivel arm and is able to slide the length of the swivel arm. The tray is attached to the slide and can display a cookbook or fold up into the shelf unit for easy storage.

13 Claims, 11 Drawing Sheets

U.S. PATENT DOCUMENTS

2001/0023916 A1* 9/2001 Armstrong ..... 248/447.1
2007/0012849 A1* 1/2007 Brady ..... 248/453
2009/0050770 A1* 2/2009 Perlman ..... 248/346.3
2009/0166504 A1* 7/2009 Lorenzatti ..... 248/444.1
2010/0314341 A1* 12/2010 Bailey ..... 211/43

* cited by examiner

COOKBOOK RACK

BACKGROUND OF THE INVENTION

1. Field of the Invention

This invention relates to the field of shelving. More specifically, the invention comprises a deployable book rack designed to be attached to a shelf.

2. Description of the Related Art

Cooking can require substantial countertop space for ingredients, cookware, etc. A majority of the time, a chef—amateur or professional—needs to utilize a recipe from a cookbook when preparing a dish. The chef typically opens the cookbook on the countertop. However, this option uses up much needed countertop space and oftentimes the chef will spill ingredients on the cookbook.

Prior art cookbook holders simply prop up a cookbook on a countertop so that a chef can easily view the cookbook. However, these holders still waste countertop space and the cookbook is still vulnerable to spills.

Therefore what is needed is a cookbook rack which attaches to a kitchen wall or existing shelf or cabinet and which can adjust such that the tray holding the cookbook can swing away from the shelf and can either display a cookbook or fold up onto the shelf for easy storage. The present invention achieves this objective, as well as others that are explained in the following description.

BRIEF SUMMARY OF THE INVENTION

The present invention comprises a rack for storing and displaying multiple cookbooks. The rack is generally comprised of a shelf unit, a swivel arm, a slide and a tray. The swivel arm is pivotally attached to the base of shelf. The slide fits over the swivel arm and is able to slide the length of the swivel arm thereby moving the tray the length of the swivel arm as well. A tray which is attached to the slide can display a selected cookbook and fold up into the shelf unit for easy storage. The tray may be folded into the shelf unit with the selected cookbook stored therein.

By allowing for the tray to move the length of the swivel arm and fold up into the shelf unit along with the swiveling capability of the swivel arm the user has the ability to position the cookbook in a desired position and fold it out of the way when finished.

REFERENCE NUMERALS IN THE DRAWINGS

| | | | |
|---|---|---|---|
| 10 | present rack | 12 | shelf unit |
| 14 | back | 16 | tray |
| 18 | swivel arm | 20 | slide |
| 22 | tray bracket | 24 | ledge |
| 26 | first side leaf | 28 | second side leaf |
| 30 | spine | 32 | attachment bracket |
| 34 | base | 36 | first side panel |
| 38 | second side panel | 40 | pivot attachment |
| 42 | book | 44 | cookbooks |
| 46 | wall | 48 | existing cabinet |
| 50 | cover | 52 | cover attachment |
| 54 | top | 56 | attachment bracket |
| 58 | countertop | | |

DETAILED DESCRIPTION OF THE INVENTION

Figure 1:
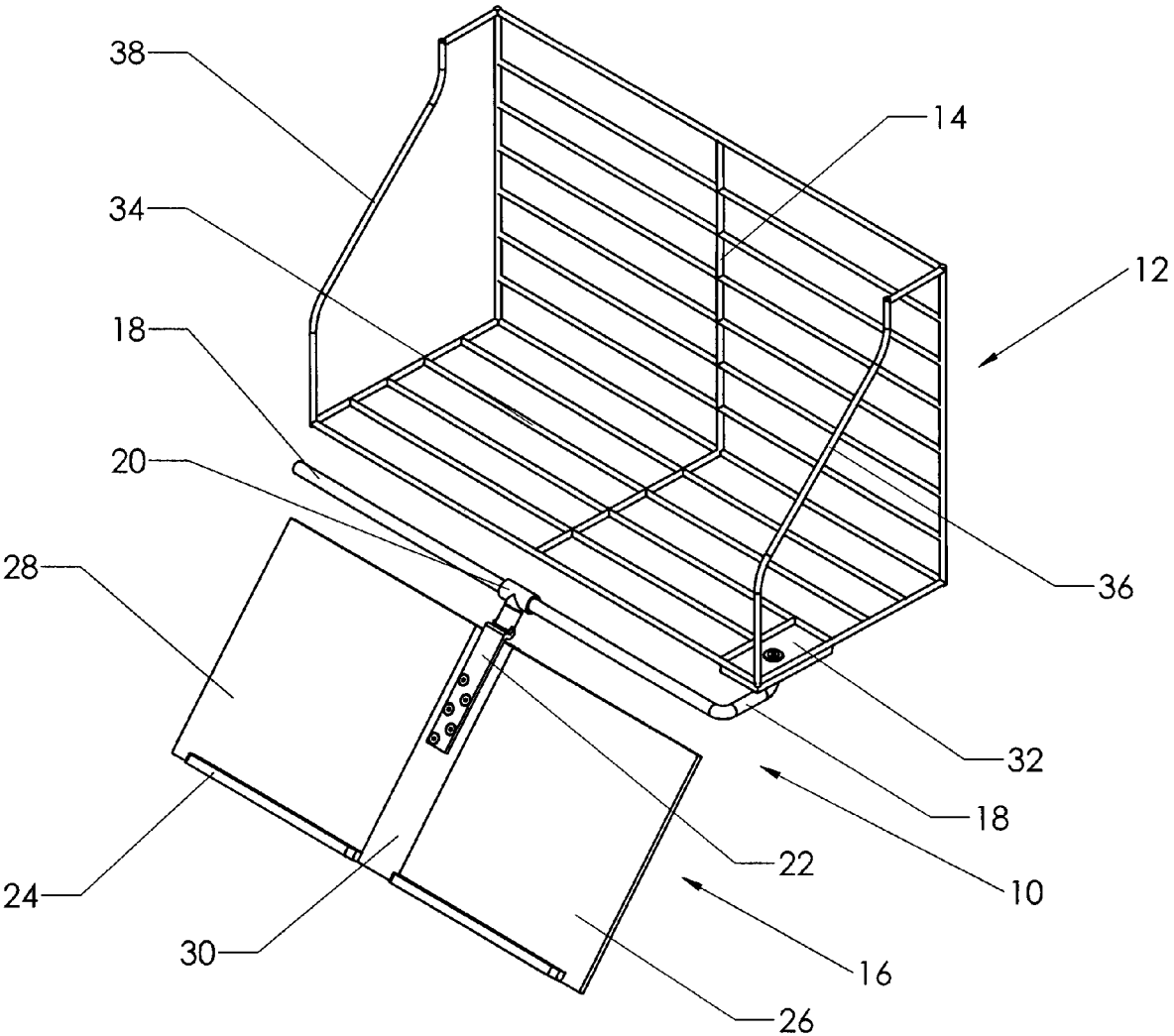
FIG. 1 is a perspective view, showing the present invention.

FIG. 1 illustrates the present invention in the preferred embodiment attached to shelf unit 12. Present rack 10 is generally comprised of tray 16, slide 20 and swivel arm 18. Swivel arm 18 attaches to shelf unit 12 at attachment bracket 32. In this example, shelf unit 12 is generally comprised of back 14, first side panel 36, second side panel 38 and base 34. Those skilled in the art will recognize that many different types of shelves or cabinets could be used. Base 34 attaches to first side panel 36, back 14 and second side panel 38. Swivel arm 18 rotates about a vertical axis contained within attachment bracket 32. Attachment bracket 32 is attached to base 34 of shelf unit 12. Slide 20 encircles swivel arm 18 such that slide 20 is able to move smoothly along the length of swivel arm 18. A stop is preferably provided on the far end of swivel arm 18 so that the slide 20 does not inadvertently slide off of swivel arm 18. Tray bracket 22 attaches slide 20 to tray 16. Tray 16 is preferably one integrated unit which is comprised of spine 30, first side leaf 26, second side leaf 28 and ledge 24.

Figure 2:
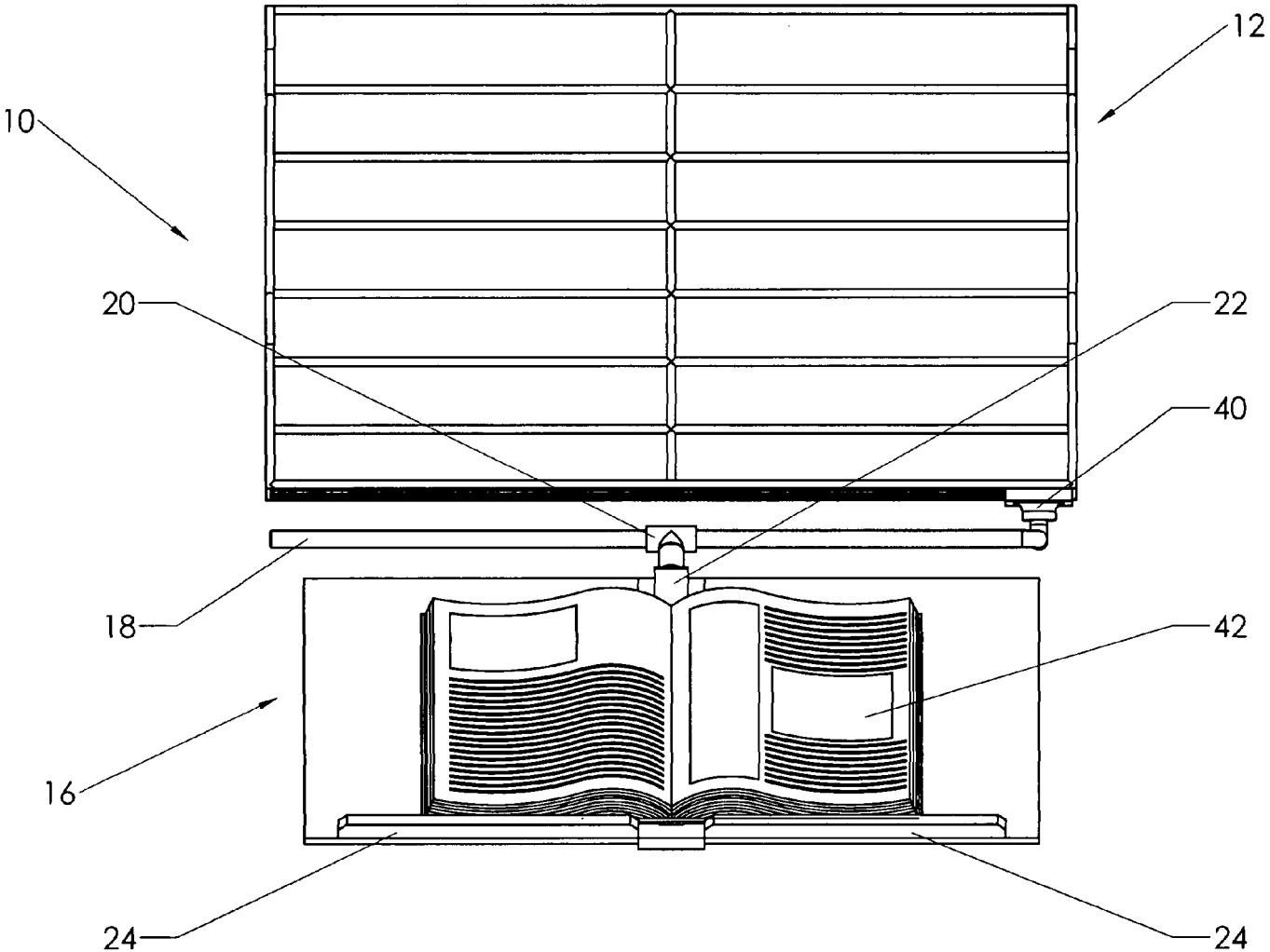
FIG. 2 is a perspective view, showing the present invention with a cookbook.

In FIG. 2 slide 20 is positioned in the center of swivel arm 18 and shelf unit 12. Swivel arm 18 attaches to pivot attachment 40 which attaches to the base of shelf unit 12 by way of attachment bracket 32 (shown in FIG. 1). Pivot attachment 40 can be any means known in the art which allows swivel arm 18 to rotate about a vertical axis. When the user rotates swivel arm 18 to the desired angular position swivel arm 18 can be fixed in place by way of a locking mechanism preferably located on pivot attachment. One skilled in the art will recognize that any means of locking swivel arm 18 in place can be used. As shown, book 42 sits on tray 16 and rests on book ledges 24 to prevent book 42 from sliding off of tray 16.

Figure 3:
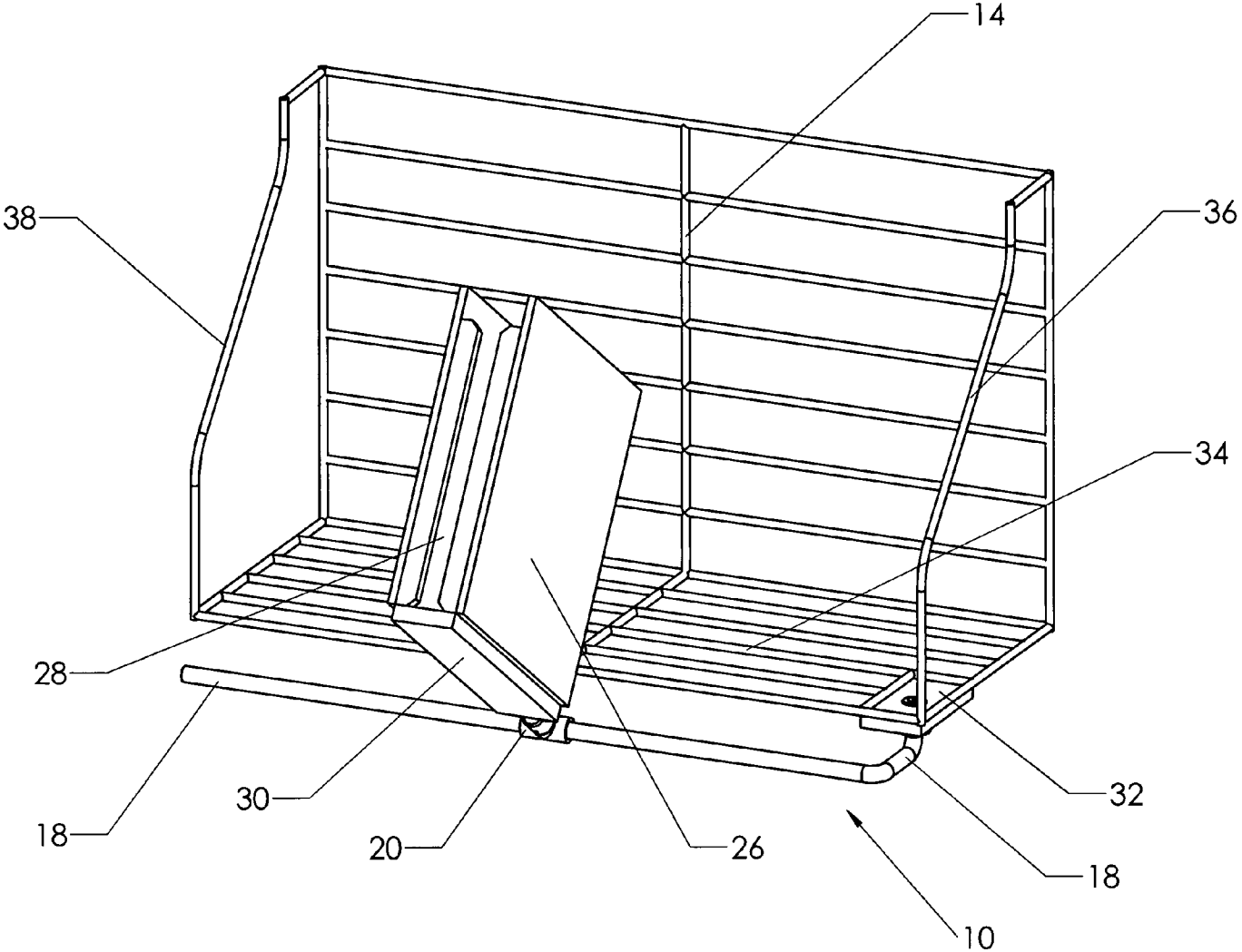
FIG. 3 is a perspective view, showing the present invention with the tray being pivoted up into the shelf unit.
Figure 4:
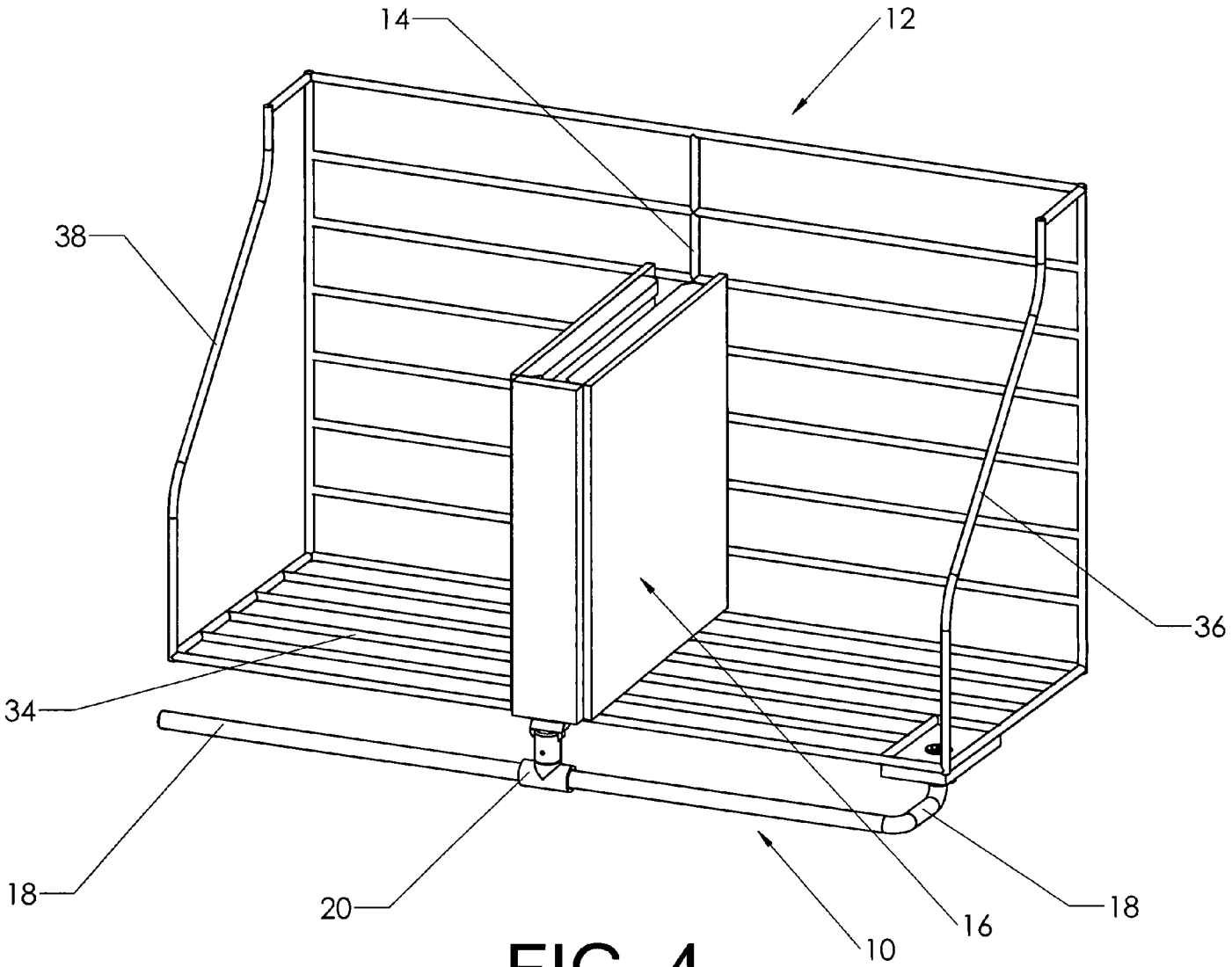
FIG. 4 is a perspective view, showing the present invention with the tray folded onto the shelf unit.

FIG. 3 shows the manner in which tray 16 folds up into shelf unit 12 for easy storage when not in use. First side leaf 26 and second side leave 28 fold upward and toward one another, similar to a book. This can be done with the selected cookbook still inside of tray 16. Once tray 16 is in the closed position, as shown in FIG. 3, the entire tray 16 rotates around swivel arm 18 at slide 20. Tray 16 comes to rest on base 34, as shown in FIG. 4. Tray bracket 22 is such a length which allows tray 16 to sit level on shelf unit 12. Tray 16 is stored in this position of shelf unit 12. The next time that tray 16 is needed the user can easily grasp tray 16 rotating tray 16 around swivel arm 18 at slide 20. A locking function feature preferably located on slide 20 is incorporated into the present invention to allow the user to adjust the pitch of tray 16 in order to adjust the angle of the cookbook. As illustrated in FIG. 2, book 42 is easily viewed where tray 16 is open and locked into place. However, the locking function would also allow tray 16 and therefore book 42 to pitch downward or upward pursuant to the user's preference.

Figure 5:
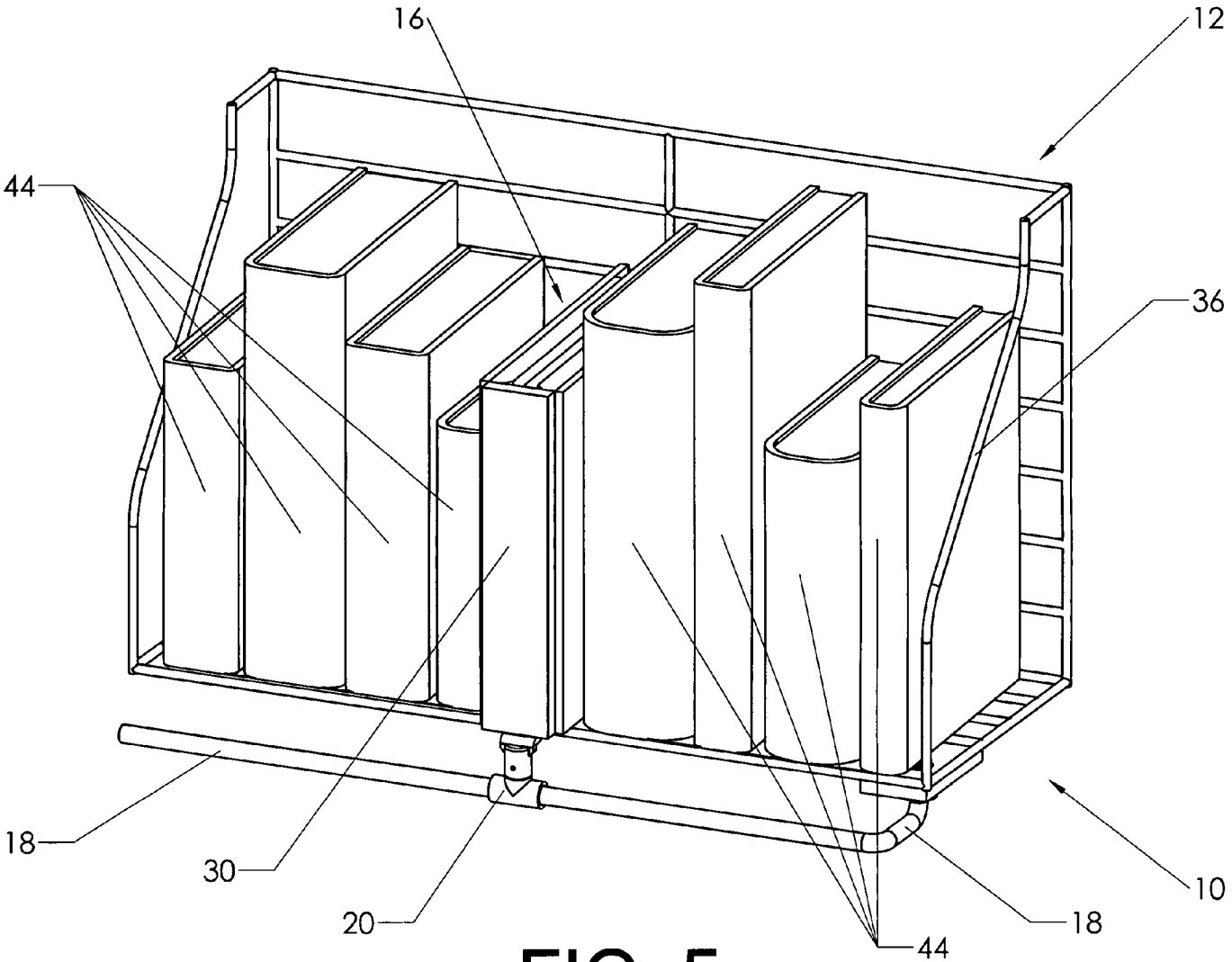
FIG. 5 is a perspective view, showing the present invention with a series of books on the shelf unit.

The illustration in FIG. 5 portrays how the present rack 10 can hold a number of cookbooks 44. Tray 16 in its closed position sits between cookbooks 44. Spine 30 of tray 16 aligns with the spines on cookbooks 44. Tray 16 may in fact contain a selected cookbook 44 when in the stowed position (not shown).

Figure 6:
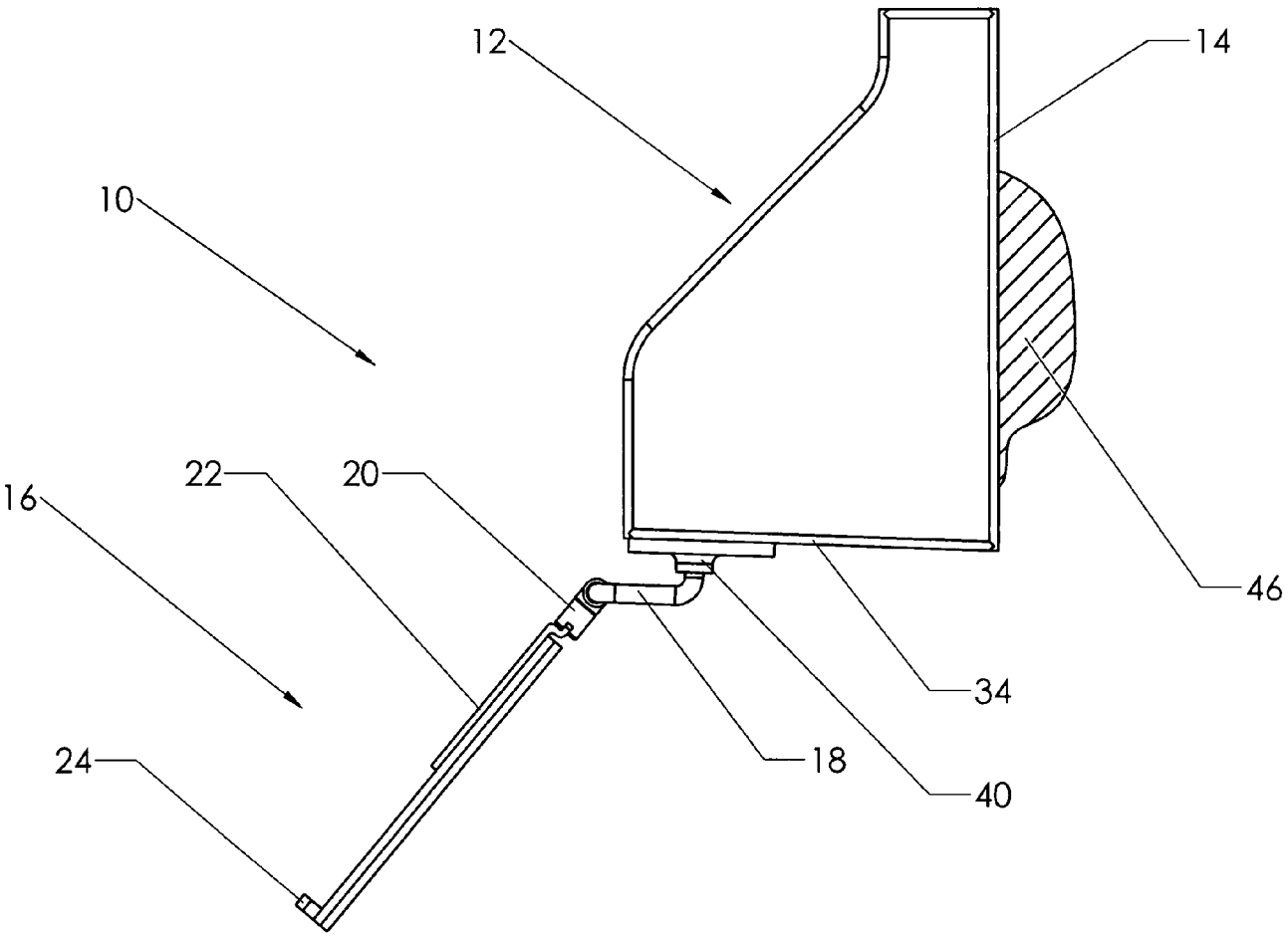
FIG. 6 is a schematic view, showing the present invention from the side.

FIG. 6 shows the manner in which the present rack 10 attaches to wall 46. Shelf unit 12 at back 14 is preferably attached to at least two studs by way of a wall bracket. However, any known means of attaching shelf unit 12 to the desired wall 46 can be used. In the alternative, pivot attachment 40 can be attached below any existing shelf or cabinet (also shown in FIG. 9).

Figure 7:
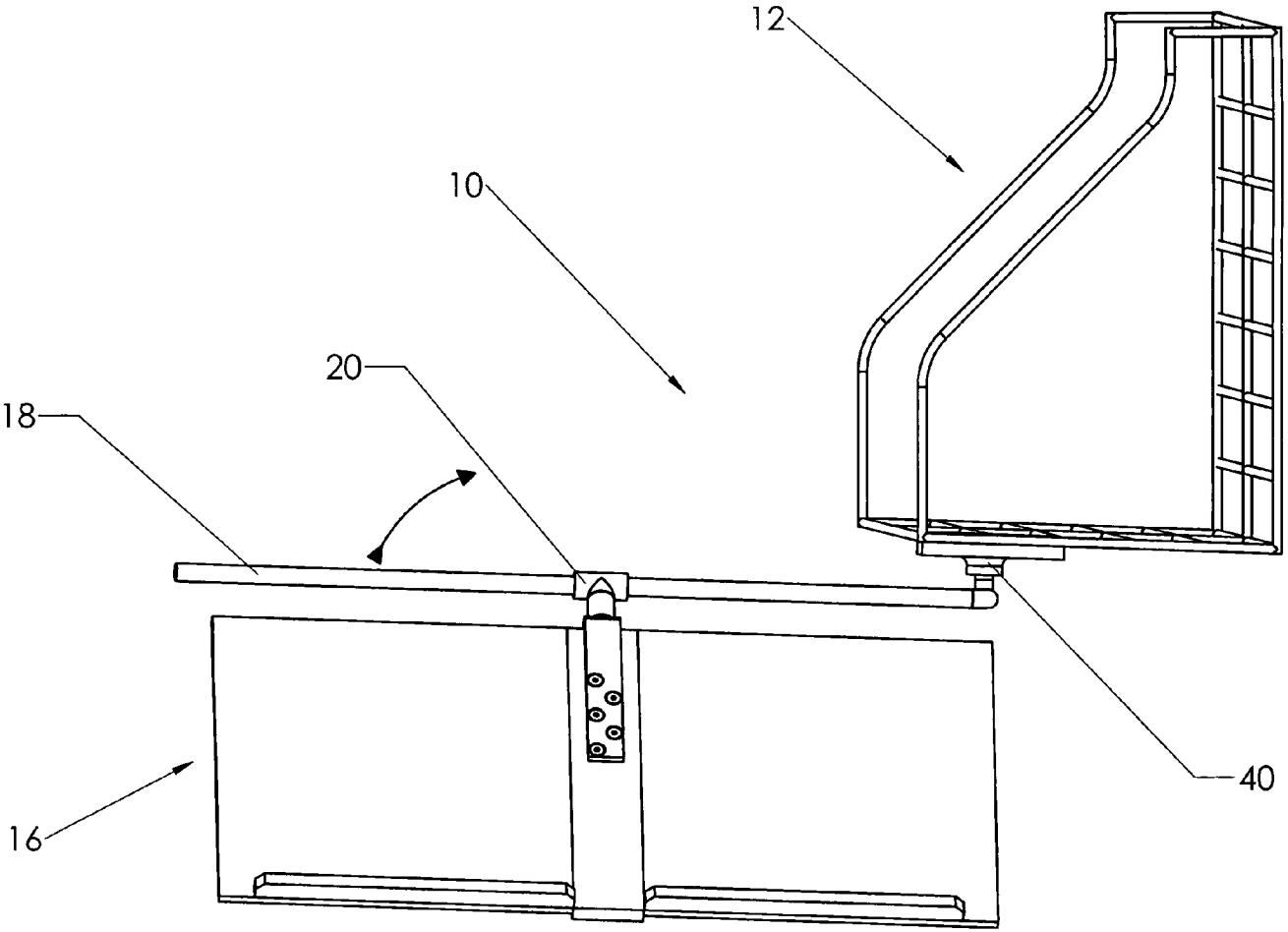
FIG. 7 is a perspective view, showing the present invention.

FIG. 7 shows the manner in which swivel arm 18 can rotate out away from shelf unit 12 (as illustrated by the arrow). The user can manipulate swivel arm 18 to the desired location such that tray 16 is in the position that is best for the user to view the book.

Figure 8:
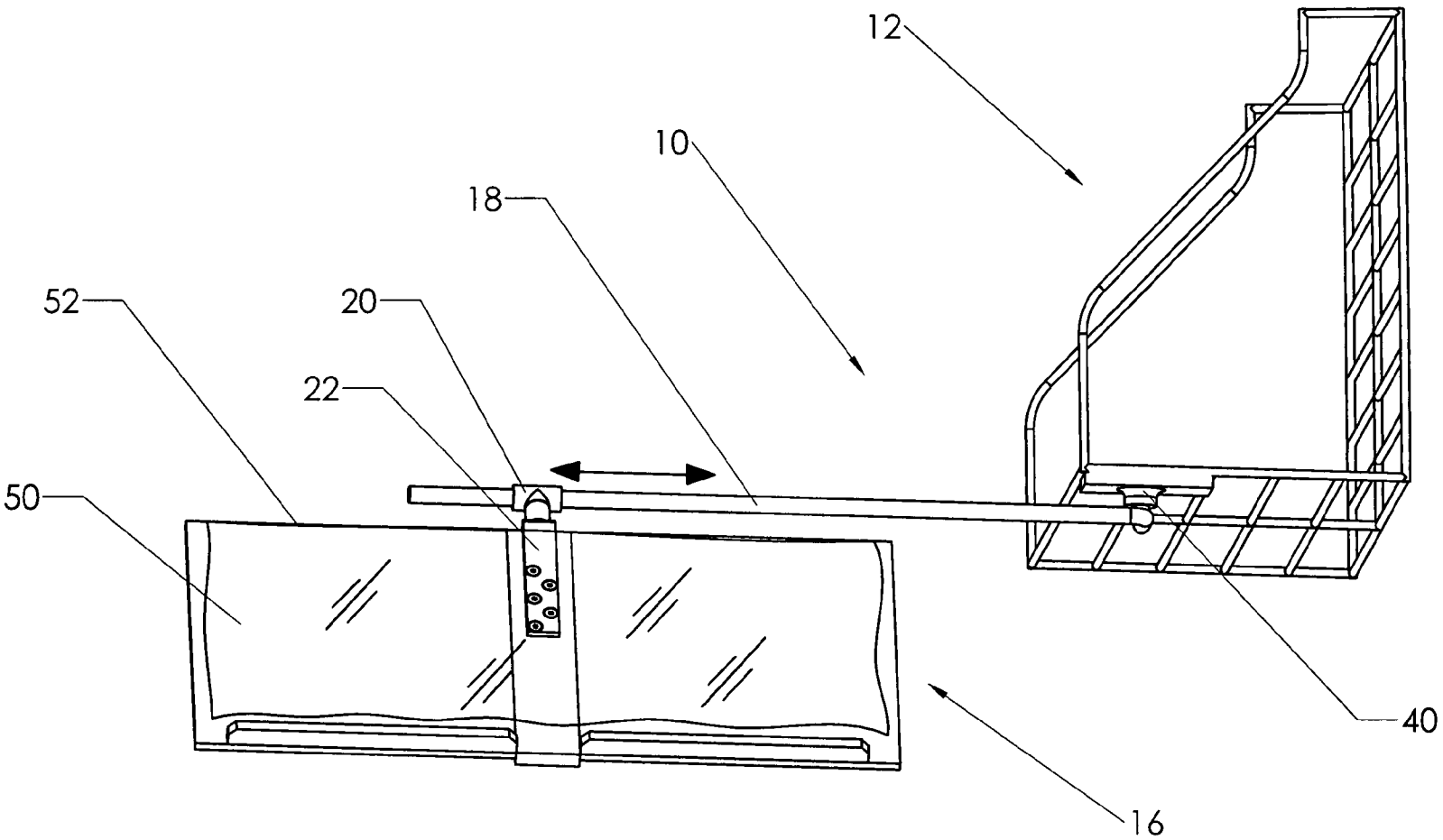
FIG. 8 is a perspective view, showing the present invention.

In FIG. 8 slide 20 is shown at the end of swivel arm 18. Slide 20 can be easily shifted back and forth along swivel arm 18, as shown by the arrow in FIG. 8. Cover 50 is shown attached to tray 16 such that cover 50 can protect cookbook (not shown) from spills or splashes when cooking. Cover attachment 52 is preferably attached to the top of tray 16 such that a user can easily place a cookbook beneath cover 50. Cover 50 is preferably a PET film which is transparent and magnifies that which the film is placed over, such that the text of the cookbook (not shown) is magnified.

Figure 9:
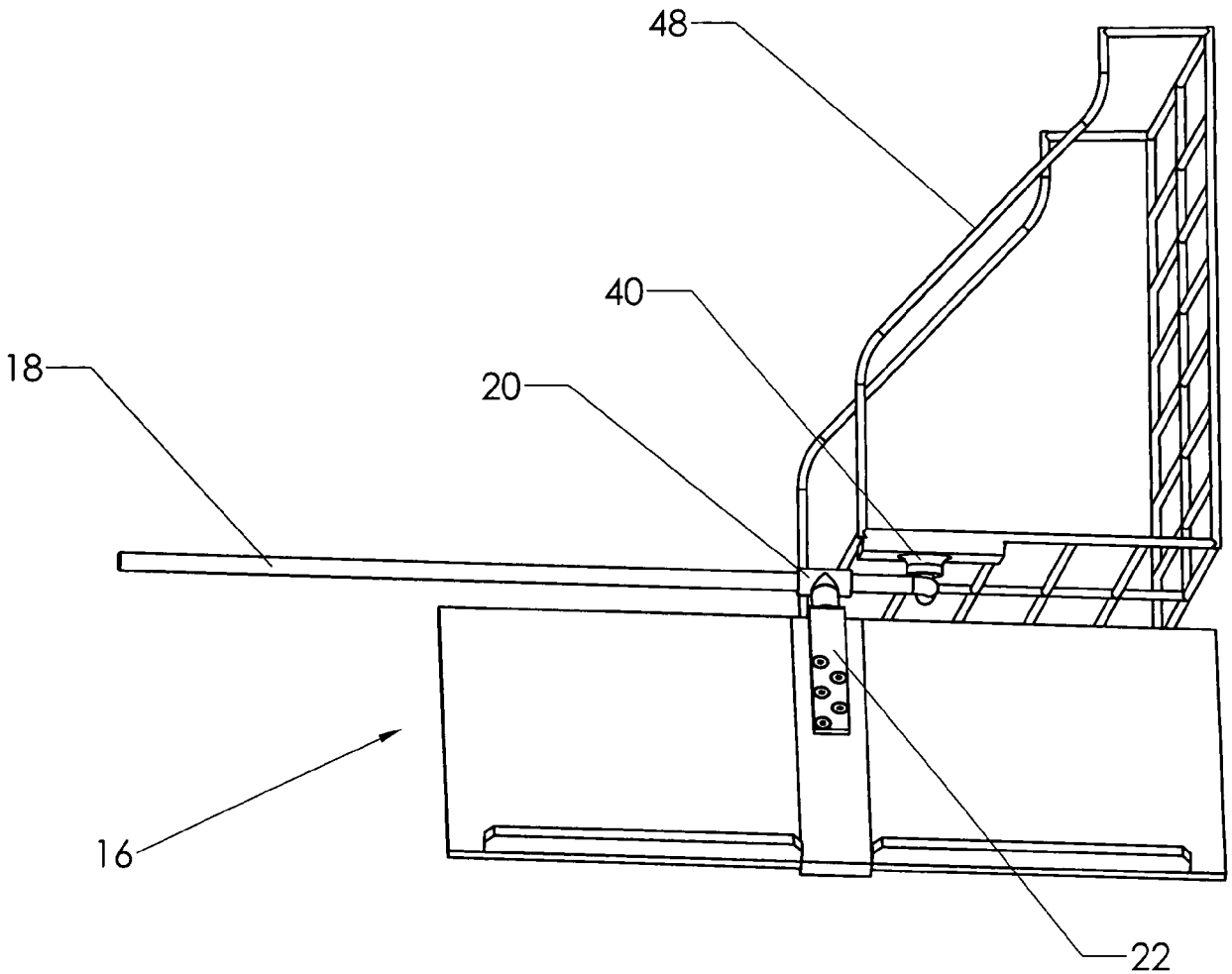
FIG. 9 is a perspective view, showing the present invention attached to an existing cabinet.

As shown in FIG. 9 slide 20 and tray 16 are slid close to shelf unit 12. Additionally, FIG. 9 shows an alternate embodiment of the present invention, wherein pivot attachment 40 is attached directly to an existing cabinet 48. The present rack 10 performs in the same manner as in the preferred embodiment however, the shelf unit 12 is replaced by an existing cabinet 48 so that the invention may be easily retrofitted to an existing kitchen.

Figure 10:
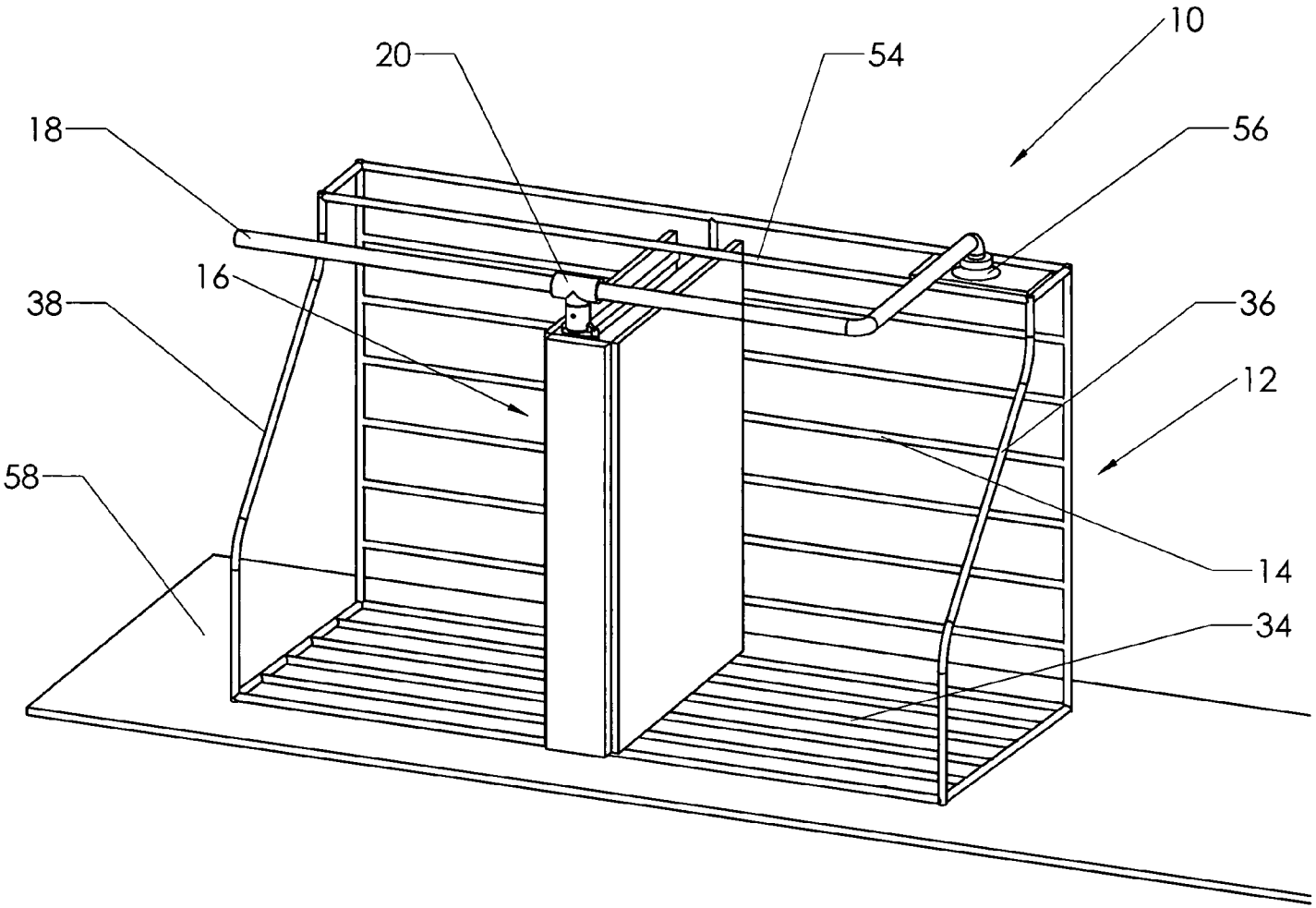
FIG. 10 is a perspective view, showing an alternate embodiment of the present invention.

FIG. 10 shows an alternate embodiment of the present invention, wherein shelf unit 12 further comprises top 54, which attaches to first side panel 36, second side panel 38 and back 14. In the alternate embodiment swivel arm 18 attaches to top 54 by way of attachment bracket 56, thus allowing base 34 to sit directly on countertop 58. Preferably a Lazy Susan, or rotating tray, would be attached to the bottom of shelf unit 12 allowing entire shelf unit 12 to rotate.

Figure 11:
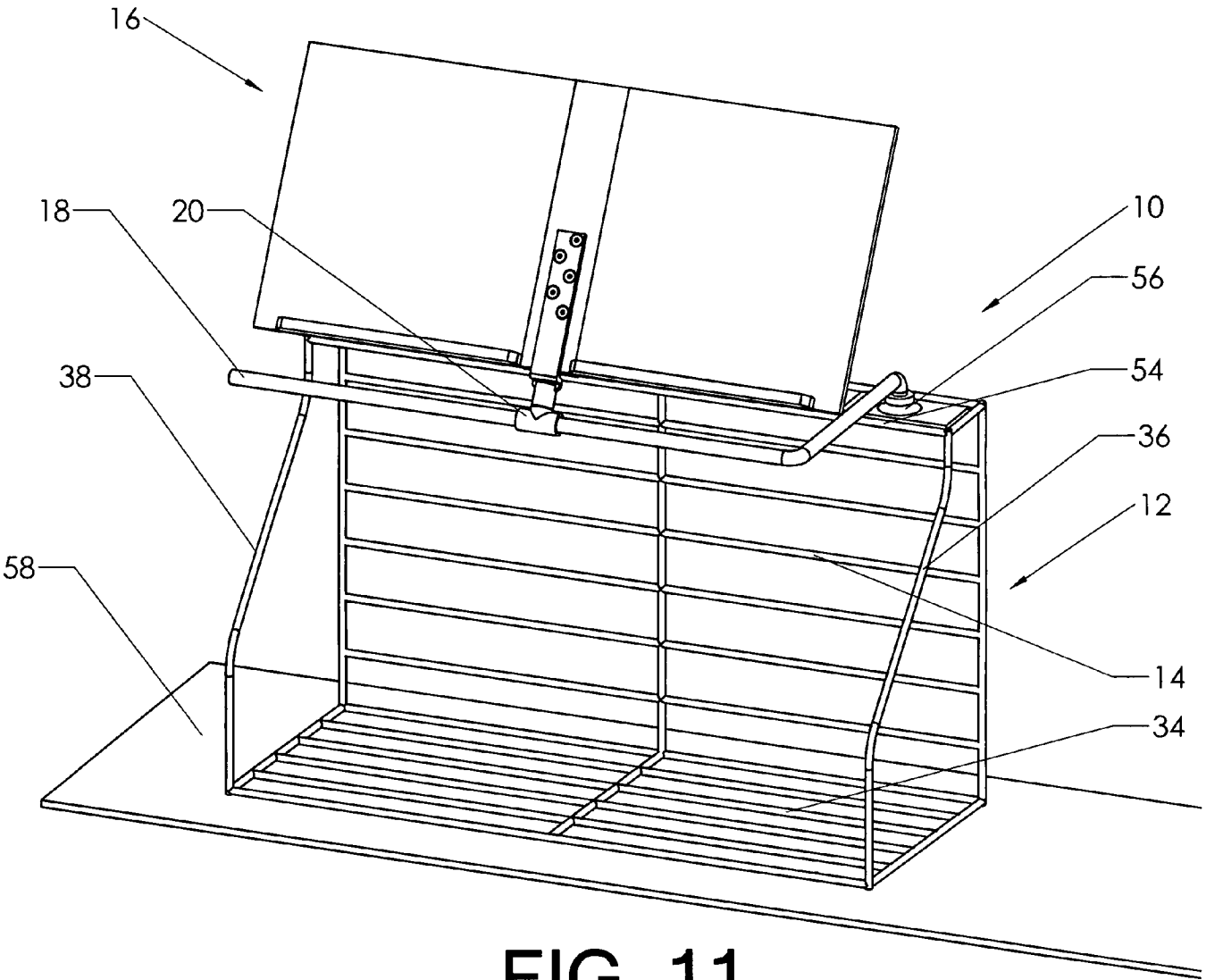
FIG. 11 is a perspective view, showing an alternate embodiment of the present invention.

As shown in FIG. 10 when tray 16 is in the closed position tray 16 preferably sits on base 34 of shelf unit 12. However, tray 16 can also hover above base 34 of shelf unit 12. As shown in FIG. 11, in the open position, tray 16 opens above top 54 of shelf unit 12. Otherwise the alternate embodiment functions in the same manner as the preferred embodiment. Swivel arm 18 still rotates about shelf attachment 56 and slide 20 still allows tray 16 to shift from one end of swivel arm 18 to the other. The alternate embodiment allows the user to set the present rack 10 in any open space.

The preceding description contains significant detail regarding the novel aspects of the present invention. It should not be construed, however, as limiting the scope of the invention but rather as providing illustrations of the preferred embodiments of the invention. As an example, any number of pivoting means could be utilized to achieve the pivoting effect which allows swivel arm 18 to rotate. Additionally, swivel arm 18, slide 20 and tray 16 could be attached directly to an existing shelf or cabinet, instead of attaching to shelf unit 12. Thus, the scope of the invention should be fixed by the following claims, rather than by the examples given.

Having described my invention, I claim:

1. A rack for holding a cookbook, comprising:

a. a shelf unit including a base having an upward facing portion configured to support at least one cookbook;

b. an attachment bracket attached to said shelf unit;

c. a swivel arm, pivotally attached to said attachment bracket by a pivot joint that pivots about a vertical axis, said swivel arm including a portion extending in a substantially horizontal direction, said portion moving through a substantially horizontal arc as said swivel arm pivots about said pivot joint, said portion occupying a position that is lower than said upward facing portion of said base;

d. a slide, attached to said portion of said swivel arm extending in said substantially horizontal direction;

e. said slide being slidably connected to said portion of said swivel arm extending in said substantially horizontal direction so that said slide can translate in said substantially horizontal direction;

f. said slide also being pivotally connected to said portion of said swivel arm extending in said substantially horizontal direction with said pivotal connection pivoting about a longitudinal axis of said portion of said swivel arm extending in said substantially horizontal direction;

g. a tray attached to said slide, said tray including, i. a spine connected to said slide, said spine having a first side and a second side, ii. a first side leaf pivotally connected to said first side of said spine by a first pivoting spine connection, iii. a second side leaf pivotally connected to said second side of said spine by a second pivoting spine connection, iv. wherein said first and second pivoting spine connections allow said first and second side leaves to fold toward each other, v. said portion of said swivel arm extending in a substantially horizontal direction, said slide, said spine, said first side leaf, and said second side leaf being configured so that said first and second side leaves can pivot toward each other and said tray can pivot upward and over a top of said portion of said swivel arm so that said tray comes to rest on said upward facing portion of said base while said tray remains above said swivel arm; and h. said pivotal connection between said slide and said portion of said swivel arm extending in said substantially horizontally direction including a locking mechanism for fixing a pitch of said tray.

2. The rack as recited in claim 1, wherein said tray further comprises:

a. said first pivoting spine connection allows said first side leaf to pivot away from said spine but restricts further pivoting once an angle between said spine and said first side leaf is 180 degrees; and b. said second pivoting spine connection allows said second side leaf to pivot away from said spine but restricts further pivoting once an angle between said spine and said second side leaf is 180 degrees.

3. The rack as recited in claim 2, wherein said tray further comprises a first ledge attached to said first side leaf and a second ledge attached to said second side leaf.

4. The rack as recited in claim 3, wherein said tray further comprises a cover configured to cover said cookbook.

5. The rack as recited in claim 3, wherein said tray is attached to said slide by a bracket attached to said spine of said tray; and wherein said bracket is configured to offset said spine from said portion of said swivel arm extending in a substantially horizontal direction a distance sufficient to allow said tray to be pivoted up and over said portion of said swivel arm and rest on said upward facing portion of said base.

6. The rack as recited in claim 1, wherein said swivel arm is attached to said base of said shelf unit by a pivot attachment such that said swivel arm can rotate from parallel with said shelf unit to perpendicular to said shelf unit.

7. A rack for holding a cookbook which a user can attach to a shelf, wherein said shelf has a base having an upward facing portion configured to support at least one cookbook, said rack comprising:

a. a swivel atm wherein said swivel arm is attached to said base of said shelf by a pivotal attachment that pivots about a vertical axis, said swivel arm moving through a substantially horizontal arc as said swivel arm pivots about said pivotal attachment, said swivel arm occupying a position that is lower than said upward facing portion of said base;

b. a slide wherein said slide encircles said swivel arm c. said slide being slidably connected to said swivel arm so that said slide can translate along said swivel arm;

d. said slide also being pivotally connected to said swivel arm with said pivotal connection pivoting about a longitudinal axis of said swivel arm;

e. a tray wherein said tray is attached to said slide, said tray including, i. a spine connected to said slide, said spine having a first side and a second side, ii. a first side leaf pivotally connected to said first side of said spine by a first pivoting spine connection, iii. a second side leaf pivotally connected to said second side of said spine by a second pivoting spine connection, iv. wherein said first and second pivoting spine connections allow said first and second side leaves to fold toward each other, v. said swivel arm, said slide, said spine, said first side leaf, and said second side leaf being configured so that said first and second side leaves can pivot toward each other and said tray can pivot upward and over a top of said swivel arm so that said tray comes to rest on said upward facing portion of said base while said tray remains above said swivel arm; and f. said pivotal connection between said slide and said swivel arm including a locking mechanism for fixing a pitch of said tray.

8. The rack as recited in claim 7 wherein said tray further comprises:

a. said first pivoting spine connection allows said first side leaf to pivot away from said spine but restricts further pivoting once an angle between said spine and said first side leaf is 180 degrees; and b. said second pivoting spine connection allows said second side leaf to pivot away from said spine but restricts further pivoting once an angle between said spine and said second side leaf is 180 degrees.

9. The rack as recited in claim 8, wherein said tray further comprises a first ledge attached to said first side leaf and a second ledge attached to said second side leaf.

10. The rack as recited in claim 9, wherein said tray further comprises a cover configured to cover said cookbook.

11. The rack as recited in claim 10, wherein said cover is a PET film.

12. The rack as recited in claim 9, wherein said tray is attached to said slide by a bracket bolted to said spine of said tray.

13. The rack as recited in claim 12, wherein said tray is attached to said swivel arm such that said tray can rotate around said swivel arm and rest in said base of said shelf unit.

* * * * *